US006442864B2

(12) United States Patent
Ringer et al.

(10) Patent No.: US 6,442,864 B2
(45) Date of Patent: Sep. 3, 2002

(54) THERMAL EQUALIZER

(76) Inventors: Volker J. Ringer, 15 Beauchamp, Chateauguay, Quebec (CA); Mohammad R. Golriz, 9 Jacksway Cres. #403, London, Ontario (CA), N5X 3T7; Christine Tourigny, 9029 Godbout, LaSalle, Quebec (CA), H8R 2H7; Sidney Gary Jones, 575 Irish Concession, Howick, Quebec (CA), J0S 1J0

( * ) Notice: Subject to any disclaimer, the term of this patent is extended or adjusted under 35 U.S.C. 154(b) by 0 days.

(21) Appl. No.: 09/809,729

(22) Filed: Mar. 15, 2001

(30) Foreign Application Priority Data

Mar. 17, 2000 (CA) ..... 2300839

(51) Int. Cl.[7] ..... F26B 21/06

(52) U.S. Cl. ..... 34/84; 34/566; 34/633; 34/463; 34/641; 239/552

(58) Field of Search ..... 34/566, 571, 633, 34/307, 369, 414, 419, 420, 421, 422, 430, 434, 510, 443–444, 463–965, 498–499, 565, 611, 629, 632, 641, 653–655, 83–84; 239/523, 524, 552, 553, 553.5, 590, 590.5

(56) References Cited

U.S. PATENT DOCUMENTS

| | | | | | |
|---|---|---|---|---|---|
| 1,170,807 | A | * | 2/1916 | Egan | 239/535.5 |
| 4,253,247 | A | * | 3/1981 | Bergstrom | 34/155 |
| 4,274,210 | A | * | 6/1981 | Stengard | 34/156 |
| 4,392,309 | A | * | 7/1983 | Schrader et al. | 34/54 |
| 4,394,950 | A | * | 7/1983 | Kramer | 226/97 |
| 4,728,277 | A | * | 3/1988 | Planeta | 425/72.1 |
| 5,070,627 | A | * | 12/1991 | Zagar | 34/156 |
| 5,531,033 | A | * | 7/1996 | Smith et al. | 34/117 |
| 5,784,804 | A | * | 7/1998 | Nowakowski | 34/446 |
| 6,079,115 | A | * | 6/2000 | Ringer et al. | 34/114 |
| 6,094,838 | A | * | 8/2000 | Lang | 34/117 |
| 6,108,939 | A | * | 8/2000 | Kittsteiner et al. | 34/585 |
| 6,202,323 | B1 | * | 3/2001 | Moller | 34/631 |

* cited by examiner

*Primary Examiner*—Ira S. Lazarus
*Assistant Examiner*—K. B. Rinehart
(74) *Attorney, Agent, or Firm*—Selitto, Behr & Kim

(57) ABSTRACT

A thermal equalizer for use in a paper web drying machine and process is disclosed. The equalizer is located at the junction of a crescent header and the associated nozzle box and its use results in a more uniform temperature and nozzle velocity in the cross-machine direction.

3 Claims, 2 Drawing Sheets

THERMAL EQUALIZER

FIELD OF THE INVENTION

This invention relates to paper web drying and in particular to the profiling of air in the drying process.

BACKGROUND OF THE INVENTION

Yankee type hoods are among the main elements in paper web drying processes and a Yankee hood is an air distribution and drying system, which operates at high temperatures. Typically, a Yankee hood is shaped to be installed over and spaced from a portion of the circumferential surface of a rotatable cylinder. The drying air is heated and pressurized in the system and is then supplied to the Yankee hood dryer where it passes through nozzles at high velocity and impinges on the moving, drying web. The spent air is then collected in the dryer and returned to a recirculation system. Some of this spent air is exhausted, but the majority of it is recirculated to conserve heat.

The heat which is transferred from the impingement air from the nozzles to the paper is used to increase the temperature of the paper to its equilibrium drying temperature; evaporates the water from the paper; and increases the temperature of the paper above the equilibrium temperature after the surface water has been evaporated.

Increasing production rates called for in the industry today result in demands for higher and higher evaporation rates. Achieving evaporation rates considerably higher than those currently available must be realized largely through improvements to the Yankee hood system. In a Yankee hood, the evaporation is driven largely by convection heat transfer, brought upon by the effect of impinging jets of hot air and radiation heat transfer. Effectiveness of hood evaporation largely depends on geometry of impingement air, properties of impingement air, and temperature.

Uneven cross-machine direction temperature profiles that are directly related to the heat transfer or drying rate, are a major problem on many paper machines. Temperature profile problems can and often originate at the crescent header and nozzle box. This is more pronounced at higher operating temperature. Temperature profile problems can be caused in the dryer section by uneven condensate removal, uneven cross-machine direction moisture profile and uneven air distribution in the supply or exhaust. It can result in operational and quality problems including reel building, corrugated rolls, converting difficulties, and rejected papers. Many mills overdry the sheet to compensate for moisture profile problems. This results in higher energy consumption and reduced production.

The present invention addresses the problem of thermal non-uniformity in the drying section of the hood by providing a combination of elements that results in a more uniform temperature and a more uniform nozzle velocity in the cross-machine direction. This means that by having a thermal equalizer and a divider plate in the nozzle boxes, more uniform thermal profiles at certain distances in cross-machine direction are obtainable.

SUMMARY OF THE INVENTION

According to the present invention, there is provided a thermal equalizer for a paper web drying machine of the type that includes nozzle boxes fed by crescent headers. The equalizer is secured in a fixed location substantially centrally in the nozzle box adjacent a junction thereof with the crescent header and is spaced from adjacent surfaces of the nozzle box and header. The equalizer comprises a structure having a distorted diamond-shaped configuration in cross-section with upper and lower longitudinal center lines and having a pair of equal area, lower surfaces and a pair of equal area, contoured, concave upper surfaces for applying direction and substantive uniformity to air from the header that flows therefrom into the nozzle box, around the equalizer and out of the nozzle box onto the paper web.

The thermal equalizer of the present invention is useful in association with the paper drying element shown in Applicant's U.S. Pat. No. 5,531,033 Control Profile Drying Hood; U.S. Pat. No. 5,784,804 Yankee Hood With Integral Air Heating System; U.S. Pat. No. 6,079,115 High Temperature Yankee Hood; and U.S. Pat. No. 6,094,838 Curl And Profile Correction With High Velocity Hoods.

DESCRIPTION OF THE DRAWINGS

The invention is illustrated by way of example in the accompanying drawings in which.

DETAILED DESCRIPTION

Figure 1:
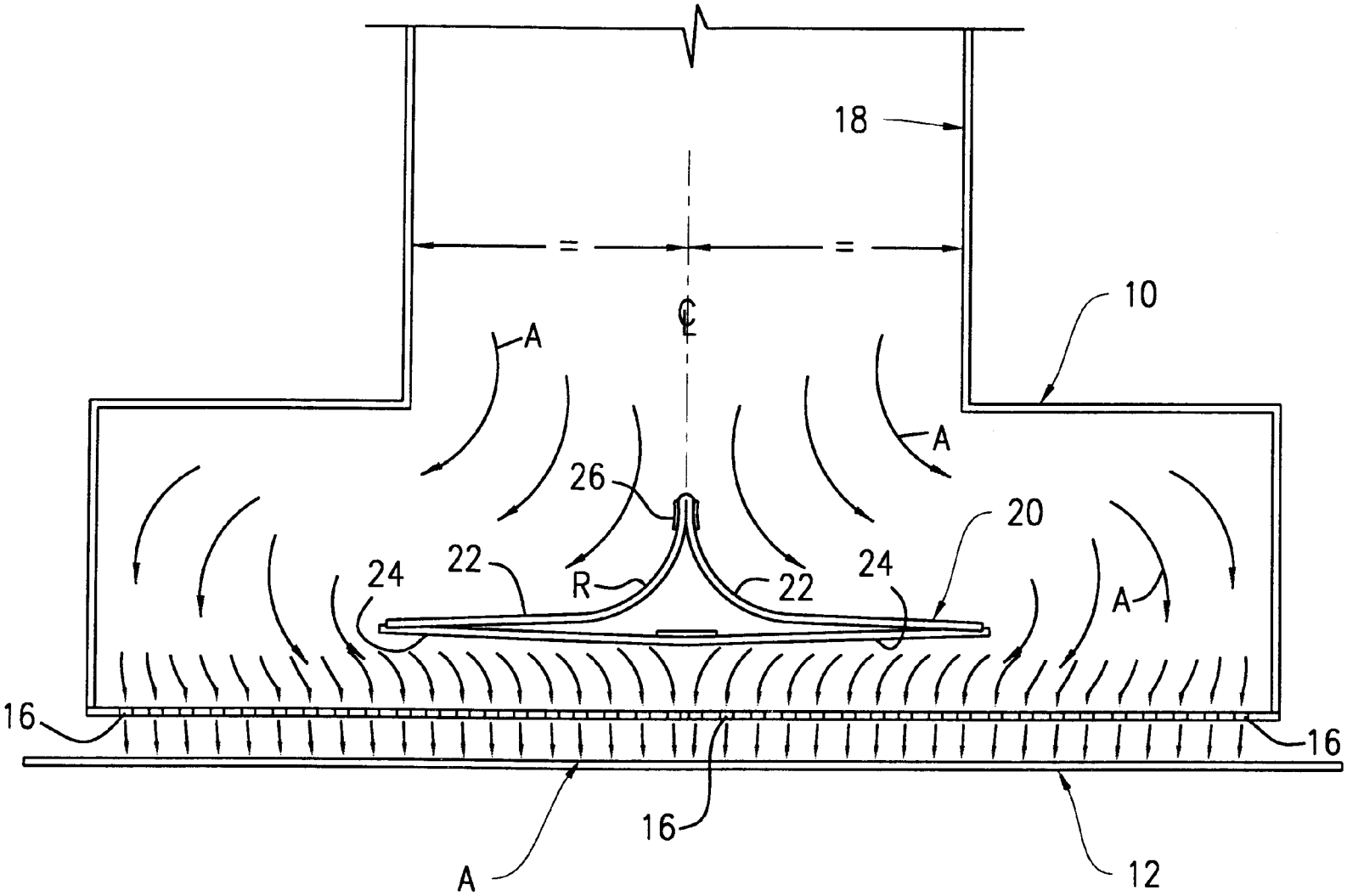
FIG. 1 is a schematic cross-sectional view of the invention, showing air flow into the nozzle box and around the equalizer.
Figure 2:
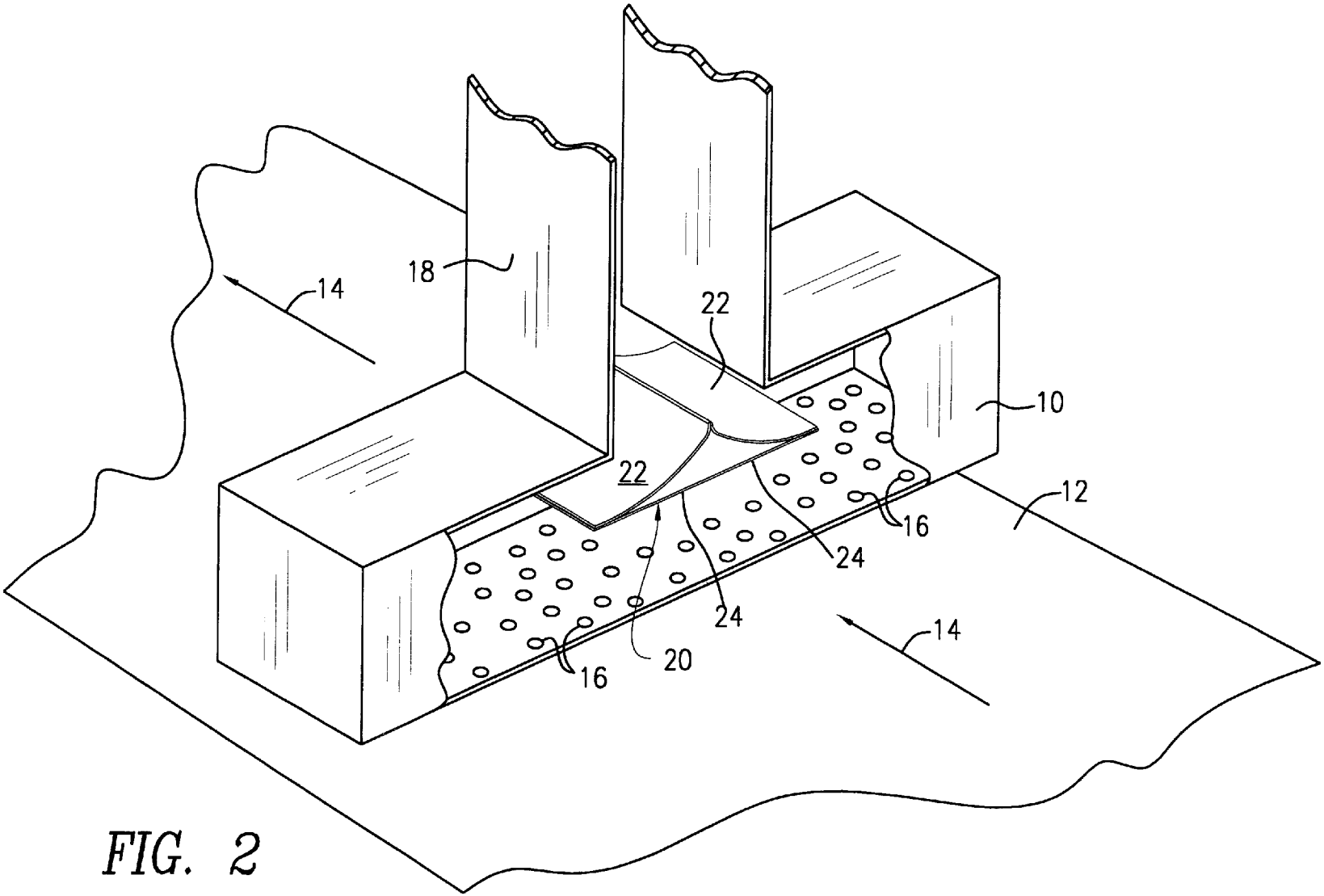
FIG. 2 is a perspective view of the invention.

Referring to the drawings, FIG. 2 provides a perspective view of a nozzle box 10 which would be one of numerous nozzle boxes in a Yankee hood and located above the surface of a paper web 12 being dried and moving in the direction of arrows 14. The nozzle box 10 is provided on its lower surface with a plurality of apertures 16 through which high pressure, heated drying air is passed as shown in FIG. 1 to impinge against the surface of the travelling web. The nozzle box 10 forms the lower, terminal end of a crescent header 18 which, in turn, forms part of the air distribution system in a Yankee hood. While only one crescent header conduit and nozzle box is illustrated, it will be appreciated that a thermal equalizer can be utilized in each nozzle box or selected nozzle boxes in the associated Yankee hood.

As illustrated, the thermal equalizer 20 is strategically located in the nozzle box so as to be engaged by the air flow coming into the nozzle box 10 from the crescent header 18.

The thermal equalizer 20 displays, in cross-section, a somewhat distorted diamond-shape consisting of a pair of upper concave surfaces 22 and generally planar lower surfaces 24 which, depending on the installation, may also display a very shallow concave configuration. The equalizer 20 is positioned by means of clips 26, as shown in FIG. 1, the clips being secured for example to the side walls of each nozzle box 10.

The paths of travel of the hot drying air coming into the crescent header 18, travelling around the thermal equalizer 20 and passing through the apertures 16, is well illustrated in FIG. 1 by arrows A. The thermal equalizer 20 will work in high temperature operating conditions as well as in low temperature operating conditions. The upper surfaces 22 are designed to turn the drying air with low loss. The radius R of the concave portions of the surfaces 22 will vary depending on the fluid dynamic conditions and the geometry of the crescent header and nozzle box being used. The lower part of the equalizer 20 is sloped to maintain a uniform, jet velocity.

The thermal equalizer 20 of the present invention reduces the heat exchange between the supply air and the nozzle box face; it reduces the velocity pressure and increases the static pressure in the nozzle box; and it mixes the supply air with cold boundary air in the nozzle box and gives a more uniform temperature evenly across the nozzle box. The combination of these effects gives a substantial uniform air jet velocity and a more uniform temperature just after the nozzle box.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitations, and there is no intention in the use of such terms and expressions to exclude any equivalents of the features shown and described or portions thereof, but it is recognized that various modifications are possible within the scope of the invention claims.

The embodiments of the invention in which an exclusive property or privilege is claimed are defined as follows:

1. A thermal equalizer for a paper web drying machine of the type that includes nozzle boxes fed by crescent headers, said equalizer being secured in a fixed location substantially centrally in said nozzle box adjacent a junction thereof with said crescent header and being spaced from adjacent surfaces of said nozzle box and header; said equalizer comprising a structure having a distorted diamond-shaped configuration in cross-section with upper and lower longitudinal center lines and having a pair of equal area, lower surfaces and a pair of equal area, contoured, concave upper surfaces for applying direction and substantive uniformity to air from said header that flows therefrom into said nozzle box, around said equalizer and out of said nozzle box onto said paper web.

2. A thermal equalizer according to claim 1 wherein said lower surfaces of the equalizer are sloped slightly downwardly and inwardly to meet at said lower longitudinal center line.

3. A thermal equalizer according to claim 1 wherein said lower surfaces of the equalizer are contoured such that they have shallow, concave surfaces that slope slightly inwardly and downwardly towards one another to meet at said lower longitudinal center line.

* * * * *